United States Patent [19]

Cobraiville et al.

[11] Patent Number: 4,746,303

[45] Date of Patent: May 24, 1988

[54] ELECTRICAL CONNECTOR WITH ANTI-DECOUPLING DEVICE

[75] Inventors: Christine Cobraiville, Chatou; Pascal Chirot, Le Chesnay; Didier Doret, Verneuil Sur Seine; Emile Lesaint, Les Ulis, all of France

[73] Assignee: Amphenol Corporation, Wallingford, Conn.

[21] Appl. No.: 904,599

[22] Filed: Sep. 8, 1986

[30] Foreign Application Priority Data

Sep. 13, 1985 [FR] France ..... 85 13631

[51] Int. Cl.[4] ..... H01R 13/623

[52] U.S. Cl. ..... 439/321

[58] Field of Search ..... 339/DIG. 2, 89 R, 89 C, 339/89 M, 90 R, 90 C; 439/312-323

[56] References Cited

U.S. PATENT DOCUMENTS

| | | | |
|---|---|---|---|
| 4,109,990 | 8/1978 | Waldron et al. | 339/89 M |
| 4,165,910 | 8/1979 | Anderson | 339/DIG. 2 |
| 4,536,048 | 8/1985 | Schildkraut et al. | 339/89 M |
| 4,588,245 | 5/1986 | Schwartz et al. | 339/DIG. 2 |

FOREIGN PATENT DOCUMENTS

| | | |
|---|---|---|
| 0039640 | 11/1981 | European Pat Off. . |
| 2103892 | 2/1983 | United Kingdom . |

*Primary Examiner*—John McQuade

*Attorney, Agent, or Firm*—Bacon & Thomas

[57] ABSTRACT

An electrical connector incorporating a male shell having a cylindrical metal body in which is lodged at least one contact of a first type, a female shell having a cylindrical metal body in which is lodged at least one contact of a second type which is to cooperate with the contact of the first type, an assembly nut (3) freely rotatable mounted on one of the shells and becoming fixed by rotation on the outer surface of the other shell and a means to prevent the accidental uncoupling of the assembly nut comprising a radial set of teeth (7) carried either by the assembly nut or by the shell carrying the nut and directed toward the other of the two elements and by a means cooperating with the set of teeth and fixed on the other element. The means cooperating with the set of teeth comprises at least one blade (41) fixed so as to form two lever arms (41', 41''), each lever arm bearing a tooth (42', 42'') adapted to cooperate with the set of teeth, the spread between the two teeth being chosen so that only one of the teeth will be in engagement at any one time.

6 Claims, 3 Drawing Sheets

FIG_3
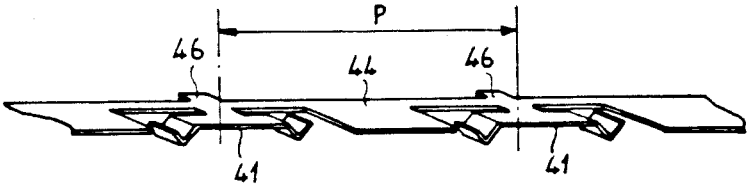
FIG_4
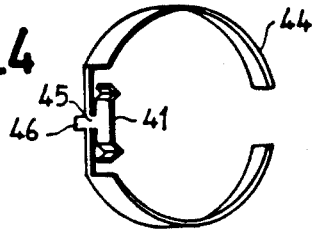
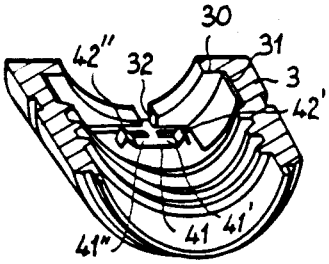
FIG_5
FIG_6
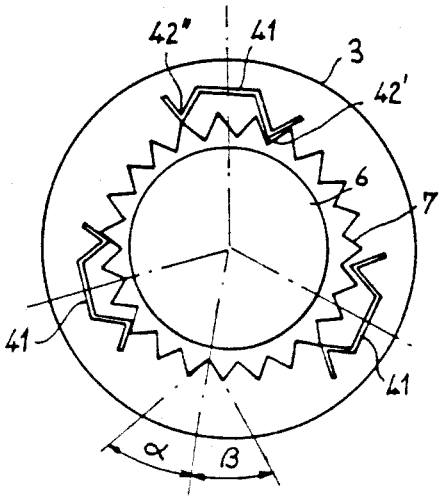

ELECTRICAL CONNECTOR WITH ANTI-DECOUPLING DEVICE

BACKGROUND OF THE INVENTION

1. Field of the Invention

This invention relates to an anti-decoupling device for a connector.

2. Description of the Prior Art

The present invention relates in a general way to electrical connectors of the type incorporating a male shell including a cylindrical metal body in which there is lodged at least one contact of a first type, a female shell comprising a cylindrical metal body in which there is lodged at least one contact of a second type cooperating with the contact of the first type, and an assembly nut for coupling the male shell and the female shell in assembled condition.

Various means are now known for assembling the male and female shells, such as assembly nuts of the bayonet type, assembly nuts of the "push-pull" type, or threaded assembly nuts.

Among these various coupling means, the threaded assembly nut is the most mechanically dependable configuration. But in contrast to other means of assembly, this nut, by its very nature, has no means capable of withstanding an accidental uncoupling when the connector is subject to vibrations.

When the connectors are used in aircraft or spacecraft, they are frequently subject to the action of strong vibrations and they can be placed or mounted in practically inaccessible locations. It is therefore necessary to equip this type of connector with improved means for preventing accidental uncoupling of the assembly nut.

There are, at the present time, different types of means for preventing any accidental uncoupling of the assembly nut.

Thus, French Patent No. 2,274,146 describes an anti-decoupling device comprising a ratchet washer that can rotate with the coupling ring. This washer is fitted with ratchet teeth in an axial direction and is urged elastically in the axial direction so that its teeth will engage in stop teeth provided on one face of a flange integral with the male shell.

French Patent No. 2,392,513 describes an anti-decoupling device comprising a radial, annular flange carried either by one of the shells or by the assembly nut, the flange being directed toward the other element and provided with radial teeth, and by an assembly carried by the other element comprising a leaf spring under tension in the direction of the flange and cooperating with the teeth of the latter by a projecting tooth.

The various devices used to prevent accidental loosening of the assembly nut are either complex and difficult to manufacture, or difficult to keep in position in a dependable and effective manner.

Consequently, in spite of the existence of numerous devices, such as those mentioned above, there is still a need for an anti-decoupling device for electrical connectors that is easy to manufacture and assemble, and extremely reliable. It would therefore be desirable to provide such a connector.

SUMMARY OF THE INVENTION

In accordance with this invention, there is provided an electrical connector comprising a male shell comprising a cylindrical metal body in which is lodged at least one contact of a first type, a female shell comprising a cylindrical metal body in which is lodged at least one contact of a second type which is adapted to cooperate with the contact of the first type, an assembly nut mounted to rotate freely on one of the shells and becoming fixed by rotation on the outer surface of the other shell, and a means to prevent the accidental uncoupling of the assembly nut comprising a set of radial teeth carried either by the assembly nut or by the shell bearing the nut and extending toward the other of the two elements and by a means cooperating with the set of teeth and fixed on the other element, characterized in that the means cooperating with the set of teeth comprises at least one blade fixed so as to form two lever arms, each lever arm bearing a tooth which is adapted to cooperate with the set of teeth, the spacing between the two teeth being selected so that only one of the teeth will be in engagement at any one time.

With this device, the latching precision is improved since it is made on a half-tooth. Furthermore, although the locking device works effectively with a single blade, there is preferably a plurality of blades evenly distributed over the perimeter of the assembly nut or the shell, depending on the particular embodiment.

According to one embodiment of the present invention, the blade is mounted to freely rotate on an axis parallel to the main axis of the connector, preferably against the bottom of the nut or on the shell bearing the nut.

In this case, the transfer of force due to the offset of latching will take place from one lever arm to the other, making for a better locking engagement.

According to another embodiment, the blade can be mounted fixedly at the level of the axis. In this case, the two lever arms act separately.

According to a third preferred embodiment, the blade of blades are integral with a strap of semirigid material which is mounted in a groove formed in the assembly nut or on the shell bearing the said nut. This embodiment acts in the same way as the fixed blade. But, in this case, the mounting of the blade is facilitated because the strap acts as a clip holder.

Furthermore, in the event that a plurality of blades is used to prevent the uncoupling of the connector, these blades will be positioned around the set of teeth so as to operate a progressive offset of the latch from one blade to the next. This arrangement can be used with the various embodiments of the blade mentioned above.

BRIEF DESCRIPTION OF THE DRAWINGS

FIG. 3 is a perspective view of an embodiment of the blades used in the present invention.

FIG. 4 is a perspective view of a strap fitted with a blade, the said strap being intended for use in an anti-decoupling device according to the present invention.

FIG. 5 is a perspective view of a coupling nut fitted with a blade as represented in FIG. 4.

FIG. 6 is a schematic diagram showing the positioning of the blades according to the present invention.

DESCRIPTION OF THE PREFERRED EMBODIMENTS

Figure 1:
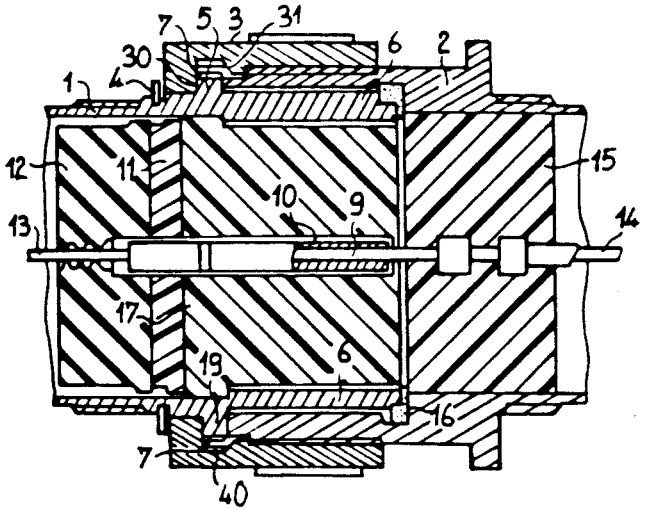
FIG. 1 is a sectional view of an example embodiment of an electrical connector which can be fitted with a locking device according to the present invention.

FIG. 1 shows a view in section of an example of a cylindrical connector which can be fitted with an anti-decoupling device according to the present invention. This connector comprises, essentially, a male shell, a female shell and a coupling nut of the threaded type to maintain the coupling of the two male and female shells.

In the example, the male shell comprises a cylindrical body 1 in which are lodged a plurality of female electrical contacts 10, only one example of which is shown in the figure. Electrical contact 10 extends, in known fashion, through a rigid dielectric 17 provided with openings for passage of the contacts such as 10, the dielectric terminating in a cylindrical plate 11 of dielectric material against which elements, not shown, abut to insure maintenance of contact 10 in the shell. A third flexible dielectric 12 in cylindrical form is likewise fixed against dielectric plate 11, up to the posterior part of the shell from which the electric wires such as 13 emerge. This flexible dielectric, under the influence of pressure, insures a seal at the rear of the male shell.

The female shell, in turn, comprises a cylindrical body 2 in which is lodged a plurality of contacts such as 9 passing through a dielectric body 15, and each one is connected to an electric wire 14 emerging on the rear face of the female shell (only one set of contact 9 and wire 14 is shown in the figure). Contact 9 projects on the front face of dielectric 15 so as to permit its connection with the female contact 10 when the male and female shells are coupled. This coupling, as represented in the figure, is maintained by a coupling nut 3 provided with a female thread which, in the present case, is screwed onto a male thread provided on the outer surface of the female shell while being maintained on the male shell by a flange forming a collar 19 integral with the latter and on its rear face by a lock washer 4. According to the present invention, flange 19 is equipped with a set of radial teeth 7 directed toward the inner surface of coupling ring 3. In addition, coupling ring 3 has, close to its bottom wall 30, a groove 31 to receive a means 40 cooperating with the set of teeth and which forms a device preventing the uncoupling of the assembly nut.

Figure 2:
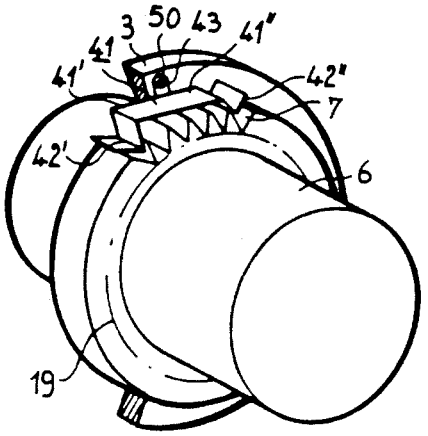
FIG. 2 is a schematic view in perspective of a device to prevent the uncoupling of an electrical connector according to a first embodiment of the present invention.

According to the present invention, and as represented clearly in FIGS. 2 and 5, means 40 cooperating with the set of teeth has at least one blade or spring member 41 fixed so as to form two lever arms 41', 41'', each lever arm 41', 41'' carrying a tooth 42', 42'' adapted to cooperate with teeth 7. Furthermore, the spacing between the two teeth 42', 42'' is chosen so that only tooth 42' will be engaged in the bottom of teeth 7 while the other tooth 42'' will be at the tip of the teeth. Thus, the locking precision will come to be on a half tooth as clearly shown in FIG. 2.

Various modes of embodiment can be envisaged for blade 41. Thus, as shown in FIG. 2, blade 41 can be an individual blade provided with a tab 43 perpendicular to the plane of the blade, the tab permitting the passage of an axle 50 to be fixed in an opening provided in the bottom of nut 3 so that the blade will be mounted pivotally on axle 50. In this case, there is a transfer of force from one lever arm to the other which improves the locking action.

According to still another preferred embodiment, as represented in FIGS. 3 to 5, the blade can be cut out and bent from a strap of semirigid material such as beryllium copper, steel or stainless steel. As clearly shown in FIG. 3, different blades 41 are cut from a single strap 44 with a fixed pitch P between blades. Then the two ends of the blades are bent to form the teeth 42', 42'', the blade remaining united to strap 44 by a tab 45 provided in the middle of the blade. In addition, spurs 46 are also cut on the strap in the extension of tabs 45. These spurs which are inserted in openings 32 provided in the bottom wall 30 of the nut prevent the rotation of the strap as the nut is maneuvered when the latter is fixed in groove 31 provided in the wall of the nut as represented in FIG. 5. A plurality of blades can be embodied on a long strap and the latter is then cut out either between each blade if means 40 comprises just a single blade, or every n blades if means 40 comprises a plurality of blades. In general, n will be equal to 2, 3 or 4 as explained in more detail below. Then the strap provided with one or more blades is coiled as represented in FIG. 4 and inserted into groove 31 provided on the assembly nut as represented in FIG. 5.

In the case where means 40 cooperating with the set of teeth incorporates a plurality of blades 41, the pitch between blades 41 is preferably chosen so as to obtain a progressive angular offset of the blades as represented in FIG. 6. With this particular arrangement, at least one of the teeth on blades 41 will always be at the bottom of the set of teeth. This arrangement can be used with blades integral with a strap as represented in FIG. 3, or with individual blades as represented in FIG. 2. Furthermore, according to a particular embodiment of the present invention represented in FIG. 6, the teeth in the set of teeth 7 have slopes forming angles $\alpha$ and $\beta$ relative to the radius passing through the tooth bottom, whose values are unequal. The use of different slopes makes the unscrewing of the nut more difficult than screwing it.

Figure 7:
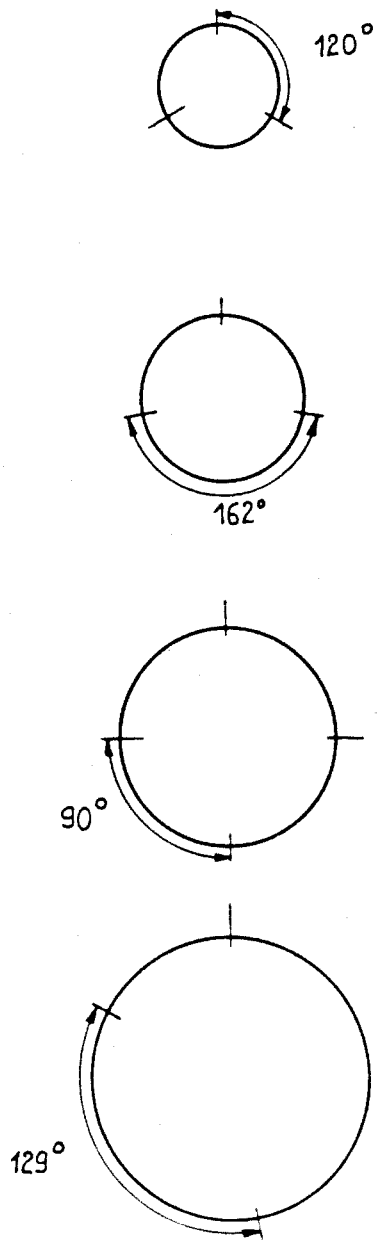
FIG. 7 represents various diagrams showing the angular positioning of the blades depending on the diameter of the connector in the case where these blades are integral with a strap with a fixed pitch.

Moreover, as represented in FIG. 7, the strap in FIG. 3 can be used for connectors of different sizes. In this case, since the pitch between the blades is fixed, the angular positioning of the blades will vary as a function of the diameter of the connector. Thus, when the pitch is 29.4 mm for diameters of 28.2 mm and 34.4 mm, means 40 will comprise three blades and the angular spread between blades will comprise between 120° and 162°, and for diameters of 37.4 mm and 43.4 mm, means 40 will comprise four blades with an angular spread of between 90° and 129°.

In another embodiment, the teeth in the set of teeth and/or the teeth of the blade may have slopes forming unequal angles relative to the radius passing through the bottom of a tooth.

The present invention has been described with reference to embodiments in which the set of teeth is carried by one of the shells while the blade or blades are fixed inside the coupling nut. It is nevertheless clear that the present invention also applies to the case where the radial set of teeth is provided inside the coupling nut, the blade or blades being fixed on the male or female shell depending on the case.

We claim:

1. An electrical connector incorporating a male shell comprising a cylindrical metal body in which is lodged at least one contact of a first type, a female shell comprising a cylindrical metal body in which is lodged at least one contact of a second type which is adapted to cooperate with said contact of the first type, an assembly nut mounted to rotate on one of the shells and becoming fixed by rotation on an outer surface of the other shell, and means to prevent the accidental uncoupling of the assembly nut comprising a radial set of teeth carried either by the assembly nut or by the shell carrying the nut and extending toward the other of the two elements and by means cooperating with the set of teeth and fixed on the other element, wherein said means cooperating with the set of teeth is constituted by at least one blade fixed so as to form two lever arms, each lever arm bearing a tooth which is adapted to cooperate with the set of teeth, the spacing between the two teeth being chosen so that only one of the teeth will be in engagement at a particular time and wherein said blade is rotatably mounted on an axis parallel to the main axis of the connector against the bottom wall of the nut or on the shell carrying the nut.

2. A connector according to claim 1, wherein said blade is mounted against the bottom wall of the nut or on the shell carrying the nut.

3. A connector according to claim 1, wherein the blade or blades are integral with a strap made of a semi-rigid material in a groove provided in the assembly nut or on the shell bearing the said nut.

4. A connector according to claim 3, wherein the pitch between the blades formed on a given strap is fixed.

5. A connector according to any one of claims 1, 3, 4 wherein the teeth in the set of teeth have slopes forming unequal angles relative to the radius passing through the bottom of a tooth.

6. A connector according to any one of claims 1, 3, 4 or 5 wherein the teeth of the blade have slopes forming unequal angles relative to the radius passing through the bottom of a tooth.

* * * * *